US006012619A

United States Patent [19]

Lam

[11] Patent Number: 6,012,619

[45] Date of Patent: Jan. 11, 2000

[54] APPARATUS CONFIGURED TO PROVIDE ELECTRICAL INFORMATION

[76] Inventor: Peter Ar-Fu Lam, 20104 Wayne Ave., Torrance, Calif. 90503

[21] Appl. No.: 08/954,699

[22] Filed: Oct. 20, 1997

Related U.S. Application Data

[62] Division of application No. 08/273,311, Jul. 11, 1994, abandoned, and a division of application No. 08/617,435, Mar. 18, 1996, Pat. No. 5,797,527.

[51] Int. Cl.[7] ..... A47G 25/14

[52] U.S. Cl. ..... 223/1; 223/85

[58] Field of Search ..... 223/85, 88, 92, 223/95, DIG. 1; D6/315, 328; 446/73, 330, 397, 175, 406; 248/550; 216/87, 26; 40/437, 541, 464

[56] References Cited

U.S. PATENT DOCUMENTS

| | | | |
|---|---|---|---|
| 152,195 | 6/1874 | Turnball . | |
| 2,710,489 | 6/1955 | Myers, Jr. | 223/85 |
| 4,739,911 | 4/1988 | Quinn | 223/85 |
| 4,973,286 | 11/1990 | Davison | 946/173 |
| 5,102,019 | 4/1992 | Lay | 223/94 |
| 5,201,443 | 4/1993 | Oswald | 223/85 |
| 5,244,431 | 9/1993 | D'Andade | 446/406 |
| 5,797,527 | 8/1998 | Lam | 223/85 |

*Primary Examiner*—Bibhu Mohanty

[57] ABSTRACT

Apparatus configured to used with a garment hangers providing visual and/or audio information for customers and end users. The apparatus include memory means for storing the information data and electrically energizable output devices for producing various motion, visual, and sound output. An electronic control circuit, which may be responsive to hanger mounted switches, preferably controls the output devices.

20 Claims, 7 Drawing Sheets

APPARATUS CONFIGURED TO PROVIDE ELECTRICAL INFORMATION

This is a divisional application of the U.S. patent application Ser. No. 08/273,311 filed by the applicant now abandoned and the divisional application of Ser. No. 08/617,435 now issued as U.S. Pat. No. 5,797,527.

FIELD OF THE INVENTION

This invention relates to apparatus for use with garment hangers and configured to provide electrical information.

BACKGROUND OF THE INVENTION

The prior art is replete with various apparatus configured to work with garment hangers for display purposes. U.S. Pat. Nos. 4,739,911 and 2,710,489 exemplify such constructions. Prior art UK Patent 18,030 discloses a hat hanger secured to a wall with a linking mechanism remote from the other side of the wall.

SUMMARY OF THE INVENTION

An object of the invention is to provide an apparatus suitable for working with a garment hanger and to be configured with various kind of electrical controlled information transducer so as to provide useful audio/visual information to the customers and the end users. A supplemental object is to configure the apparatus to convey useful and interesting information to the child user.

An apparatus in accordance with the invention is characterized by a first mounting member to mount the apparatus onto an external supporting object such as a closet rod or a panel, housing member to accommodate a variation of electronic circuitry and a second mounting member to receive the hook of a garment hanger. Typical examples of the panel to be mounted includes a door, a wall or an office partition. Embodiments of the invention are primarily intended for accommodating an electrically controlled circuitry which produces useful visual and/or audio information to the end users.

In accordance with one embodiment of the invention, the apparatus includes a decorative plate located, for example, at the medial portion, which is preferably detachably mounted so that different plates can be interchanged by the user. The plates are variously configured and preferably carry graphic representations of different two and three dimensional designs.

In accordance with a significant optional feature of the invention, an electrically control circuit module is supported on the apparatus for controlling one or more electrically energizable output transducers (e.g., visual, sound, motion) carried by said apparatus and capable of producing an interesting output display for a user. Such apparatus preferably carries one or more electrical switches which control the operation of the aforementioned control circuit. Each such switch can be mounted on the hanger to respond to a specific condition, e.g., (1) when a garment is placed on the hanger arms, and/or (2) when the hanger suspension member is placed on the mounting member of the apparatus. Trigger signal derived from a sensor such as the switch closure provides an input to the control circuit to initiate or otherwise control various functions including:

timing control;

LED pattern control;

LCD information display;

melody sound generation and voice sound generation;

voice recording and playback function;

motion generation;

clock function; and game function.

Various embodiments in accordance with the invention carry one or more output transducers. Thus, in certain embodiments, visual output devices are used to produce useful visual information such as product information; appealing visual patterns and/or to animate a graphic representation. Sound output devices are employed to generate melodies and/or voice phrasing. Motion output devices such as a motor are employed to produce various additional visual effects.

In accordance with another important characteristic of the invention, the electrically controlled circuit module of the apparatus comprises of memory means to store the information data to be produced and the instruction data to manage how the information is to be produced. The apparatus further comprises of a control circuit means to drive the output transducers according to the data stored in the memory device. The process usually requires decoding of the memory data, provides timing signals and power drive to the transducers.

In accordance with another useful feature of a preferred embodiment, a recording circuit comprising a voice sensor such as a microphone is further included to record voice messages and store the data into the memory device. The voice data is reproduced when a playback trigger signal is received. This will enable users to record reminder voice messages which will be reproduced when the garment hanger, or the overcoat hung on the hanger is accessed.

In accordance with another preferred embodiment, the data to be stored in the memory means is downloaded from an external data source such as a computer. This arrangement may require an interface mean such as infra red signal receiver, radio frequency receiver or data port to receive data from the external data source.

The novel features of the invention are set forth with particularity in the appended claims. The invention will best be understood from the following description, when read in conjunction with the accompanying drawings.

DETAILED DESCRIPTION

The present application is primarily directed to an apparatus suitable to receive a garment hanger and to produce visual/audio information to end users. Typical embodiment of the invention includes a housing member, electrical control circuitry, trigger means or actuators, power source and the electrically energizable transducers. Embodiments in accordance with the invention are particularly configured to provide useful audio/visual information to customers such as price, material, information of the designer and characteristics of the garment displayed. Embodiments designed with sufficient appeal to children may also be provided to encourage their use of garment hangers and thus develop good garment care habits. Additionally, embodiments in accordance with the invention are intended to convey both useful and interesting information to the child user.

Figure 1:
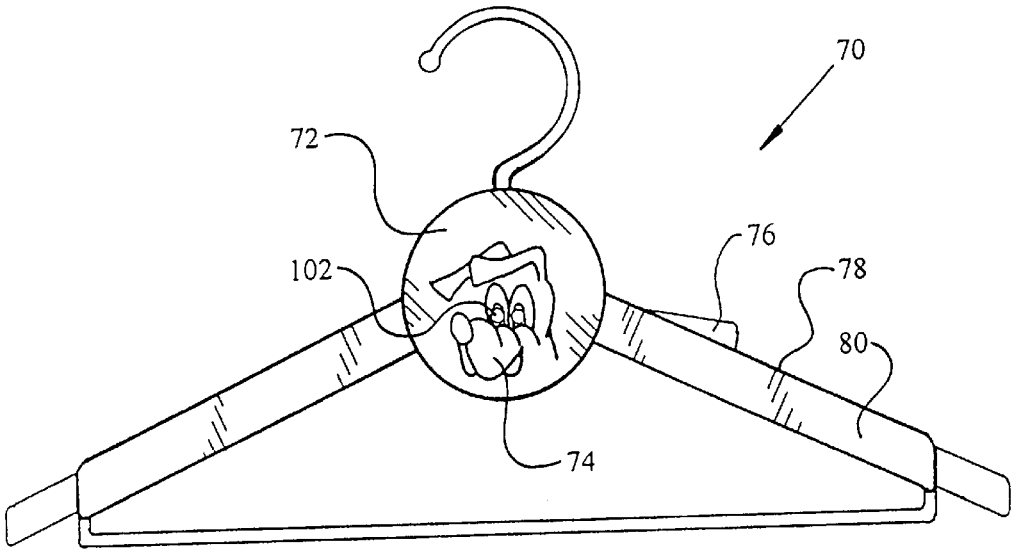
FIG. 1 is a front elevation view of an embodiment of the present invention incorporating a decorative plate and showing a switch actuator mounted on one of the hanger proximal arms.
Figure 2:
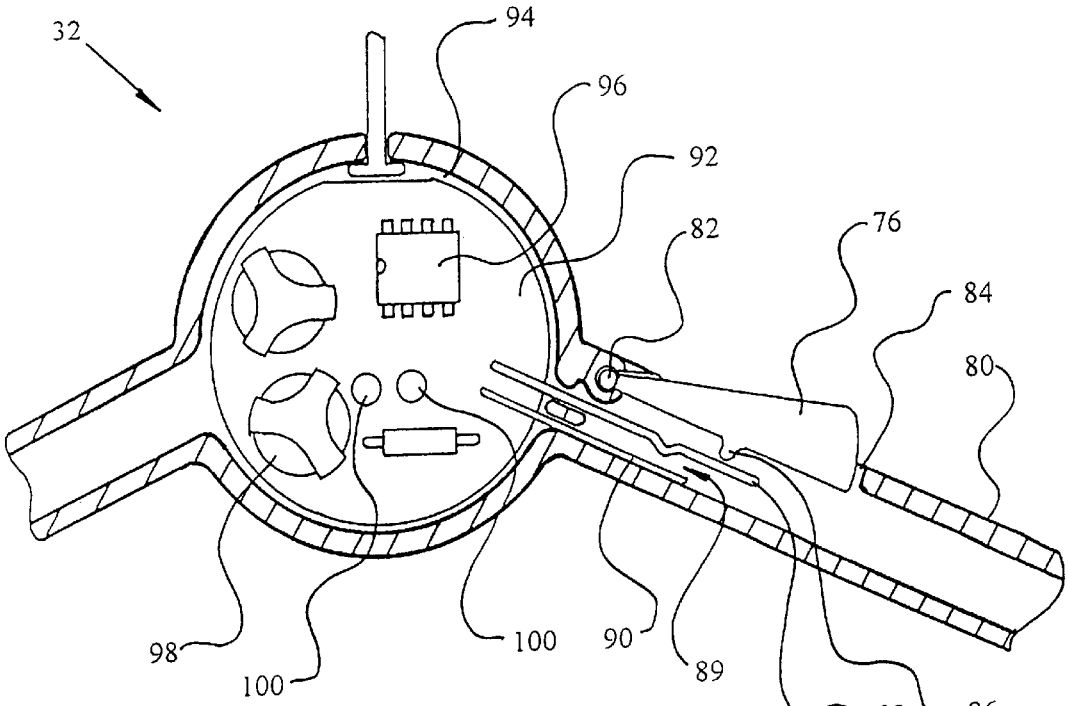
FIG. 2 is an enlarged sectional view, partially broken away, showing an electronic module mounted within the medial portion of the hanger of FIG. 1.

FIG. 1 illustrates a hanger embodiment 70 configured for child use, depicted with a decorative plate 72 bearing a graphic representation of a cartoon character 74. The hanger embodiment 70 incorporates a switch actuator 76 which extends above the upper surface 78 of hanger arm 80. FIG. 2 depicts the switch actuator 76 in greater detail. Note that it is mounted for pivotal movement around axis 82 and extends through opening 84 in arm 80. Actuator 76 includes a projection 86 positioned to engage a first contact 88 of switch 89. Switch contact 88 is mounted in close proximity to a second switch contact 90. Note that in the condition depicted in FIG. 2, switch 89 is open. That is, the electrical path between contacts 88 and 90 is open. However, when the switch actuator 76 is pivoted clockwise as viewed in FIG. 5, under the weight of a garment placed on arm 80, the contacts 88, 90 are brought into engagement; that is switch 89 is closed. The switch 89 is connected to a circuit board 92 which is accommodated in a recess 94 formed in the frame medial portion 32. FIG. 2 depicts several components on the circuit board 92 including an electrical control circuit integrated chip 96, button power cells 98, and one or more output devices 100. When the switch 89 is closed, the integrated circuit chip 96 is actuated, or triggered to drive the output device 100. The output devices 100 preferably comprise light emitting diodes (LED). These LEDs are intended to be positioned on the circuit board 92 at a location coincident with features, e.g., "eyes" 102 forming part of the graphic representation 74 formed on the decorative plate 72 (FIG. 1).

From the description thus far of FIGS. 1 and 2, it should be apparent that closure of the switch 89, under the influence of switch actuator 76, can cause the energization of LEDs 100 to illuminate the "eye" areas 102 of graphic representation 74 of FIG. 1. The electronic control circuit 96 controls various parameters of the energization of the LEDs such as for example, timing control and pattern control in a manner well known in the art.

Figure 4:
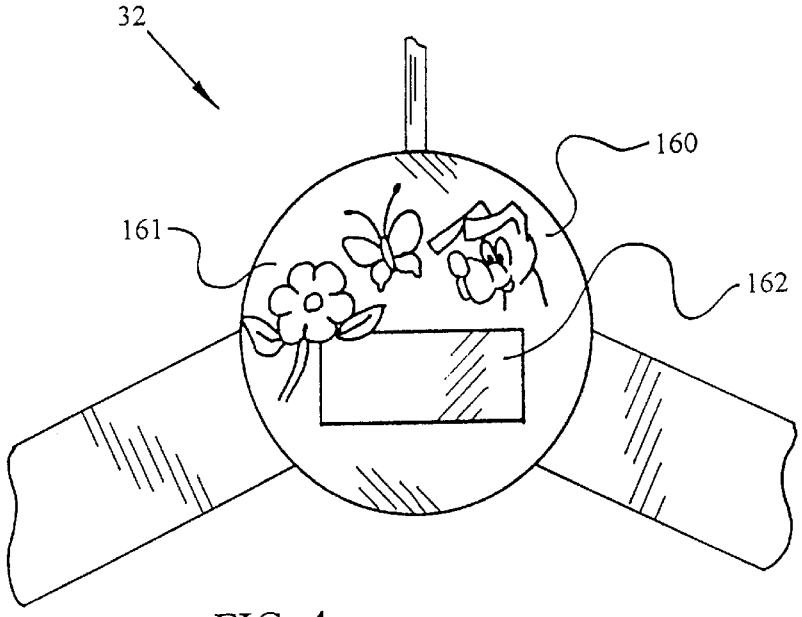
FIG. 4 is a partial front elevation view of a further hanger embodiment showing a decorative plate having an area for transducing the visual data.

FIG. 4 illustrates alternative representation of the visual transducer 100. The decorative plate 60 is shown as including a surface area portion 161 having an electronic display area 162. Typically this display area is made of visual display means such as Liquid Crystal Display (LCD) or Light Emitting Diode array (LED). The display area 162 corresponds to the LEDs 100 and driven by the electronic circuit 96, can accommodate a digital watch display or an electronic game display. More particularly, the display area can be used to scroll useful visual information to customers about the garment displayed so as to enable customer to shop in a relaxing atmosphere and obtain relative information about the product usually available only from trained sales representatives.

Figure 3:
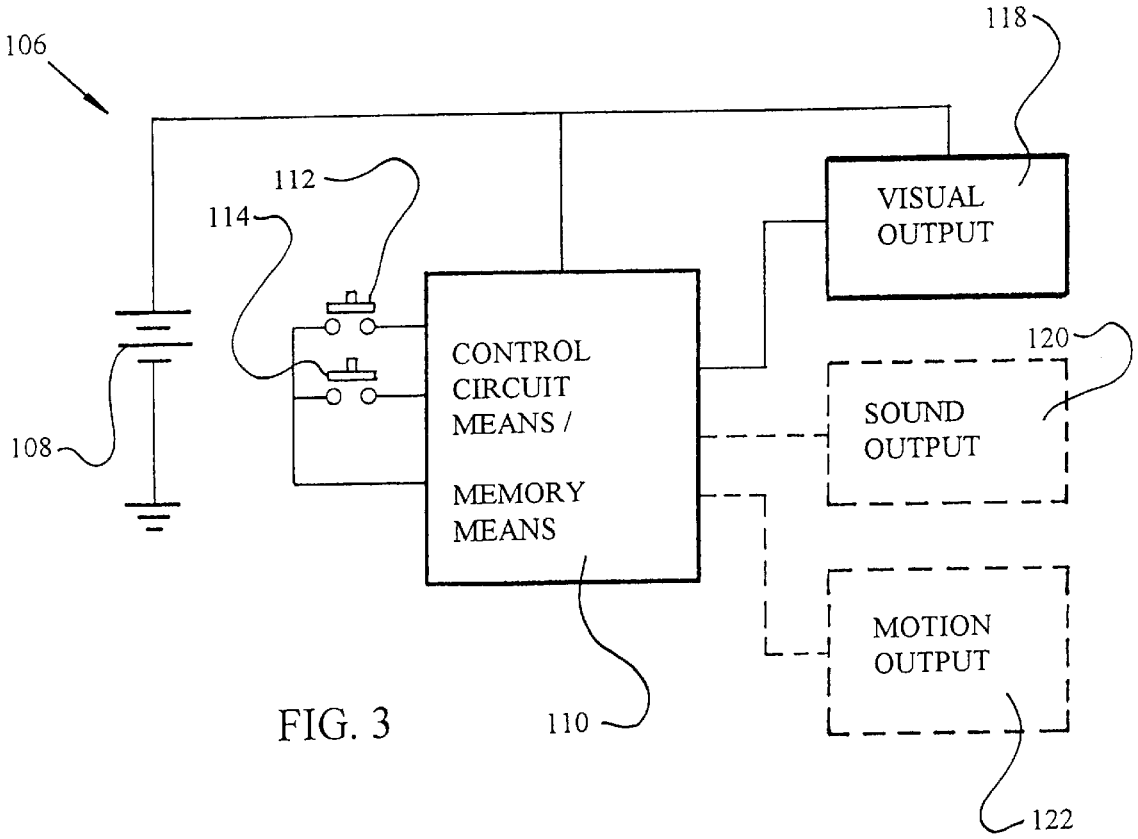
FIG. 3 is a block diagram representing an electronic module and switches in accordance with an embodiment of the present invention.

Attention is now directed to FIG. 3 which, in block form, represents the circuitry 106 carried by circuit board 92 of FIG. 2. The circuitry 106 includes a power supply 108 comprising, for example, the aforementioned button power cells 98. Additionally the circuitry 106 includes an electronic control circuit means 110 which comprises the aforementioned integrated circuit 96. Connected to the input of circuit 110 are one or more electrical switches 112, 114. Switch 112 can, for example, correspond to switch 89 structurally depicted in FIG. 2. Switch 114 can, for example, correspond to switch 116 structurally depicted in FIG. 5 and to be discussed hereinafter.

The output of circuit 110 is connected to one or more electrically energizable output devices such a visual effect or light generating output device 118, a sound generating output device 120, and a motion generating output device 122. The aforementioned LEDs 100 (FIG. 2) and LCD panel 162 (FIG. 4) represent a preferred form of output device 118. A typical sound generating output device 120 would comprise a buzzer or miniature speaker. A typical motion generating output device 122 would comprise a small motor capable of moving or rotating a decorative plate or portion thereof to for example move an element of a graphical representation to simulate an "arm" waving or an "eye" winking.

The control circuit means 110 typically includes interfacing circuit to receive trigger or actuation signals received from switches 112, 114, driver signals to drive the transducers 118, 120 and/or 122. It should be noted that different kinds of sensors in addition to mechanical contact switches are also applicable to provide the triggering signal required and should be included in the scope of the invention. Examples of other commercially available sensors are magnetic switches, gravitational switches, optical sensors and proximity sensors. Internally, the control circuit means may further includes memory means to store information data about the information to be produced, such as encoded data representing synthesized messages. The memory means may further store instruction data to manage how the information is to be produced, such as the message to be linked to a particular switch, the timing of the signals and the order of the information reproduction. The memory means may compose of Random Access Memory (RAM), Read Only Memory (ROM), Charge Coupled Device (CCD) and any other commercially available digital or analog memory. It is convenient to fabricate the memory and the control circuitry into a single integrated circuit (IC). The method for the control circuitry to decode the information data stored inside the memory means is well know in the art of electronic engineering. In case of RAM, the data stored in the memory can be derived from a sound sensitive device such as a microphone or from an external data source such as a computer. An interfacing circuit such as an infra red receiving channel, radio frequency receiver, inductor, or a data port may be required to properly receiving the data to be down loaded.

Figure 5:
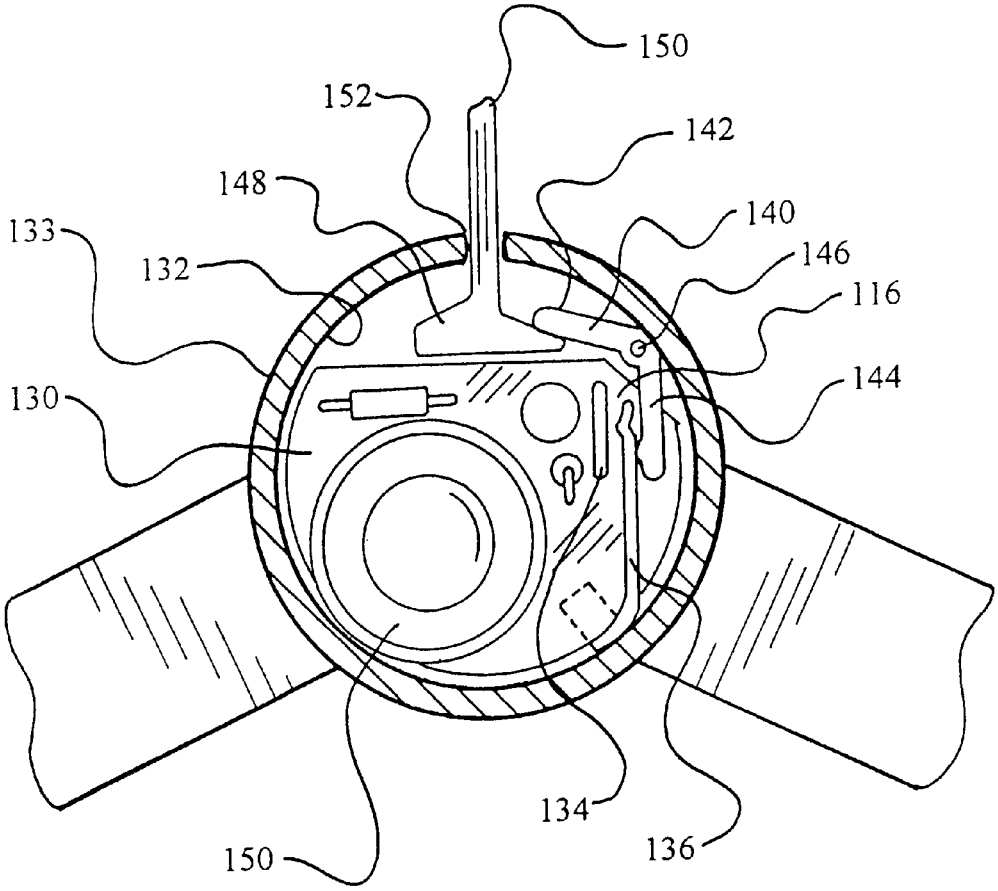
FIG. 5 is a front elevation view, partially broken away, showing an alternative switch in which the actuator is connected to the hanger suspension member.

FIG. 5 illustrates a similar but alternative arrangement to that depicted in FIG. 2. More particularly, FIG. 5 depicts a circuit board 130 mounted within a recess 132 of frame medial portion 32. The circuit board 130 carries a switch 116 defined by fixed switch contact 134 and spring contact 136. Spring contact 136 is normally biased open, i.e., as shown in FIG. 5, disengaged from fixed contact 134. A lever 140 having perpendicular arms 142 and 144 is mounted for pivotal movement around pin 146. Lever arm 142 is engaged by a foot portion 148 of a suspension member 150. The suspension member 150 extends through an opening 152 in the wall 133 of the medial portion 32.

In the use of the apparatus depicted in FIG. 5, when the suspension member is placed on a conventional support rod, the foot portion 148 will move vertically relative to medial portion wall 133 thereby pivoting lever 140 about pin 146. As a consequence, lever arm 144 will move spring contact 136 into engagement with fixed contact 134 to thus close switch 116. Recall that the physically represented switch 116 in FIG. 5 typically corresponds to the electrical switch 114 depicted in FIG. 3. Similarly, the physically represented switch 89 in FIG. 2 corresponds to the electrical switch 112 of FIG. 3. From the foregoing, it should be apparent that the physical switch 89 of FIG. 2 functions to sense when a garment is placed on the hanger arm 80 whereas the switch 116 of FIG. 5 senses when the hanger is placed on a support rod (not shown). Various other physical switch configurations can be used in conjunction with a hanger frame in accordance with the invention. Regardless of the particular switch configuration utilized, it functions to control either directly, or preferably through a control and synthesis circuit 110, output devices 118, 120, and 122. As previously mentioned, LEDs 100 of FIG. 2 and LCD 162 of FIG. 4 comprise typical visual effect output devices 118. A speaker 150 mounted on circuit board 130, as shown in FIG. 5, comprises one form of sound generating output device 120. The sound generating output device 120 can be advantageously used to generate speech, e.g., "WELCOME TO ABC FASHION STORE", or to play a melody or produce other sound effects such as breaking glass.

The aforementioned control circuit means is further modified to include a recording/playback function to enable the user to record different reminder messages from time to time The message is playback whenever a garment is accessed from the garment hanger configuration. Typical application allows the reminder message to be reproduced when the user is ready to leave home and pick up the overcoat from the garment hanger configuration. Alternatively the user may return home and retrieve the message left by another member of the family when the overcoat is being hung onto the garment hanger configuration.

Figure 7:
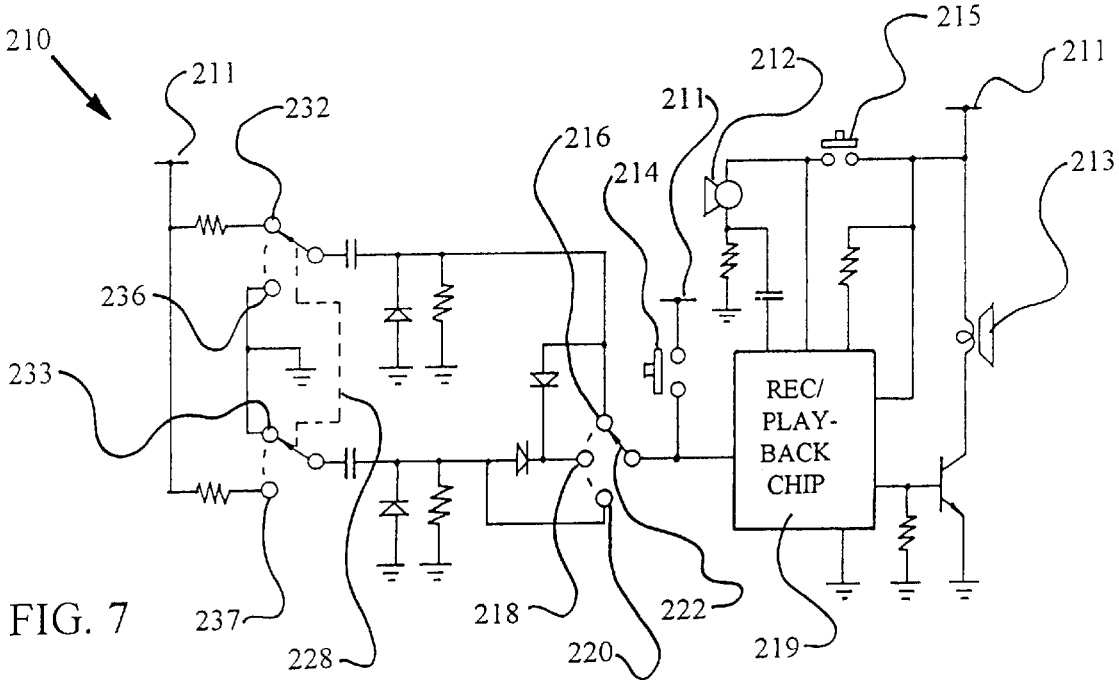
FIG. 7 is the electrical schematic representing a recording/playback circuitry configured to work with a trigger switch engaged with the suspension member of a garment hanger.

FIG. 7 discloses an embodiment 210 to provide the recording/playback function to the invention. The schematic in FIG. 7 includes a sound to electricity transducer, represented by a condenser microphone 212 to pick up audio signal. When the record button 215 is pressed, the audio signal picked up by the sound to electricity transducer represented by the condenser microphone 212 is received by the controller integrated circuit 219 which encode or convert the audio signal into digital data and stored into the memory means as aforementioned. Switch 228 is a two pole two throw switch with positions 232 and 233 connected when the garment hanger is off hook. Positions 236 and 237 represent the on hook position. Switch 222 is a user selectable mode switch. Position 216 represents the playback to be triggered only when the garment hanger is moved to the off hook position. Position 218 represents the playback to be triggered only when the garment hanger hook is loaded or engaged to a supporting device. Position 220 represents the playback to be triggered when the garment hanger in both the on hook and the off hook positions. The design enables the user to select when the recorded message is to be playback automatically. Switch 214 enables the user to repeat the record message or to sequentially browse through multiple recorded messages when required.

Figure 8:
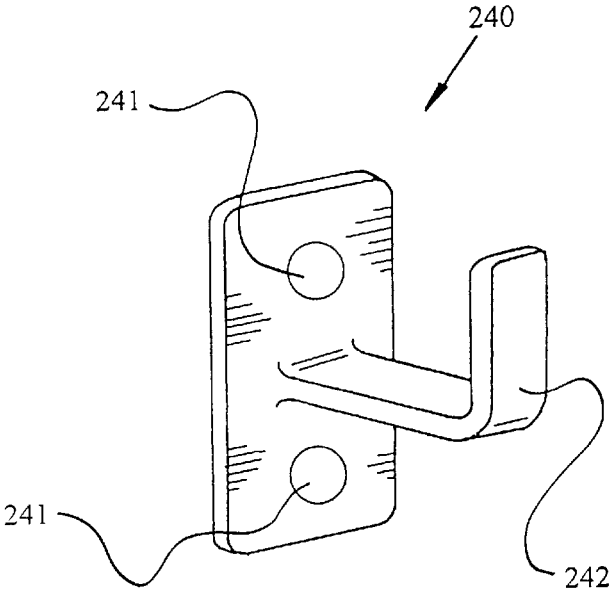
FIG. 8 is a regular wall mounted hook suitable for holding a garment hanger.
Figure 9:
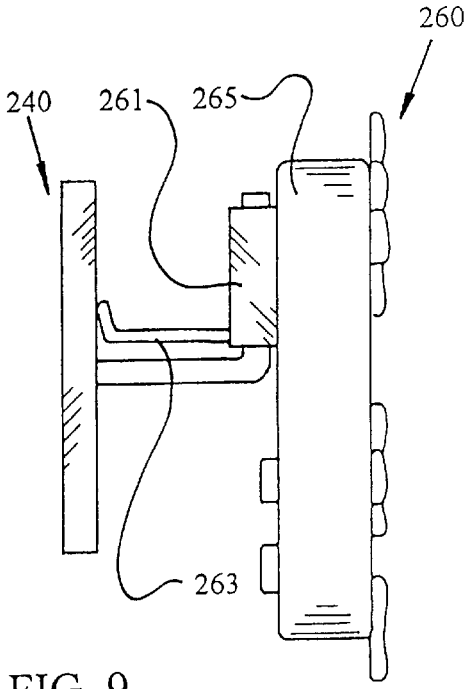
FIG. 9 is a side view of an alternate embodiment illustrating a mounting device configured to be in use with a garment hanger as a set, the information transducing circuitry is mounted on the mounting device rather than the hanger itself; the transducing device is actuated when the garment hanger is engaged or disengaged from the mounting device.
Figure 10:
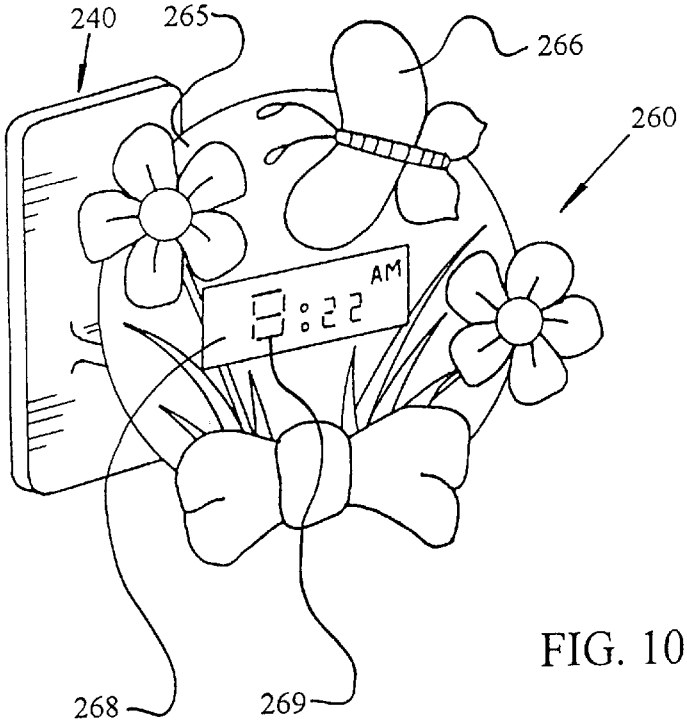
FIG. 10 shows the front view of the mounting device of FIG. 9.
Figure 12:
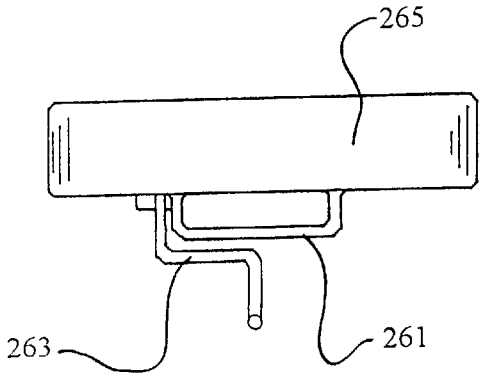
FIG. 12 shows the top view of the mounting device of FIG. 9.

In order to mount the aforementioned embodiments of the invention against a panel such as a wall, a door or an office partition, it is convenient to add into the configuration of the invention a mounting device which is configured to receive the hook of the garment hanger. FIG. 8 is a regular panel mounting device 240 structured with a hook 242 to receive the garment hanger as disclosed in FIGS. 4 and 5. The configuration of FIG. 8 combined with FIG. 5 can be further modified such that the electrical portion and the actuation mechanism of the configuration to be positioned at the mounting device. FIG. 9 and FIG. 10 illustrate an alternative embodiment of the configuration which includes an intermediate mounting device 260 engaged with the panel mounting device of FIG. 8. By relocating the electrical control circuitry and the actuators into the housing 265 of the mounting device 260, regular garment hangers can be combined into the configuration to provide the similar desirable result. The receiving slot 261 as shown in FIG. 9 and FIG. 12 acts as a mounting means to be engaged with the hook 242 of the mounting device 240. The actuator lever 263 becomes a mounting means to receive the hook of a regular garment hanger. Another alternative modification of the embodiment of FIGS. 9 and 10 is to combine the mounting device 240 and the intermediate mounting device 260 into an integral assembly. In this case, the mounting holes 241 illustrated in FIG. 8 becomes the mounting means of the invented configuration and enabling it to be mounted to a panel such as a wall or a door. It should be noted that the first mounting means, the slot 261 and the second means, the lever 263 may be integrated to form an integral mounting means to perform both functions.

Figure 6:
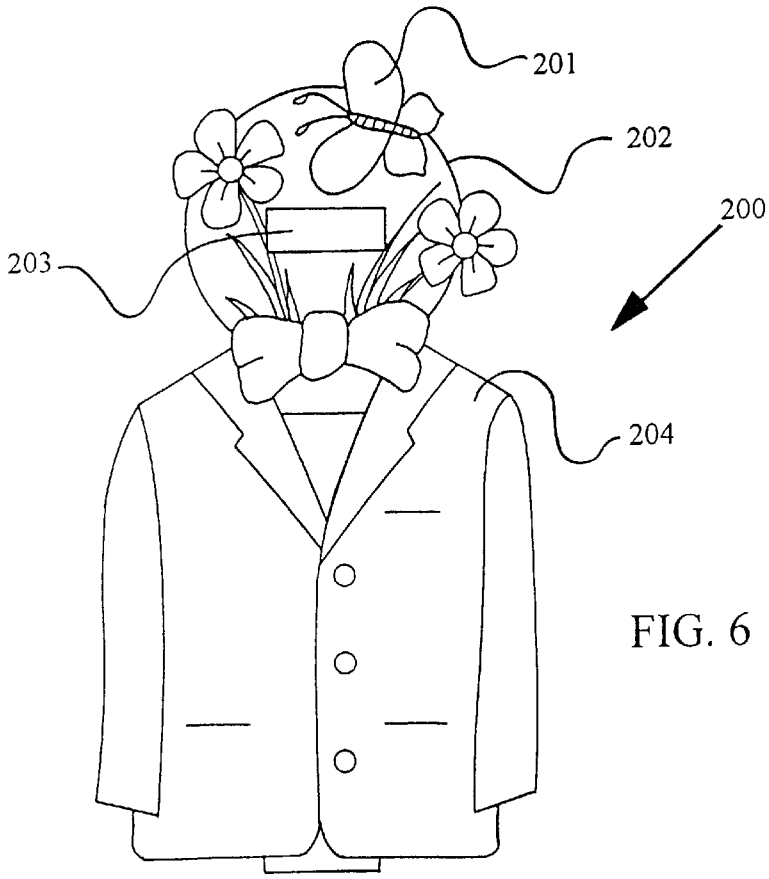
FIG. 6 illustrates a garment displayed on a hanger configured with a decorative plate and a visual display area.

Attention is now directed to FIG. 10 which illustrates the front elevation view of the mounting means 260. In front of the housing 265 is the decorative front panel 266 and the display area 268 which corresponds to the display area 162 of FIG. 4. The information displayed 269 may comprise of alphanumeric or graphical information depends on the application requirements. FIG. 6 illustrates the front view of the embodiment in combination with a garment supported with a garment hanger and hung onto the supporting hook 242. When the displaying message requiring clocking circuit such as the clock illustrated, an oscillator circuit is to be included into the electrical control circuitry.

Figure 11:
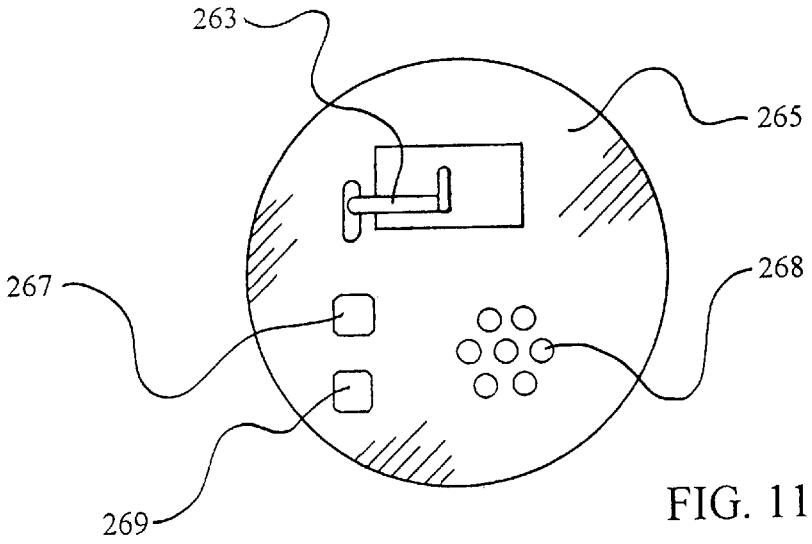
FIG. 11 shows the rear view of the mounting device of FIG. 9.

With continuing reference to FIGS. 11 and 12 which illustrates the rear view and top view of the embodiment, the lever 263 triggers the electrical control circuitry when a garment hanger is hung onto it. Behind the holes 268 locates the miniature speaker 289 (shown in FIG. 13) representing the sound transducer. Switches 267 and 269 are designed to enable end user to preset the electrical control circuitry depends on the product requirements. In the situation of the recording playback circuitry of FIG. 7, the hook switch 228 is linked to the lever 263 and the record, playback switches 215 and 214 are represented by the buttons 267 and 269 respectively.

Figure 13:
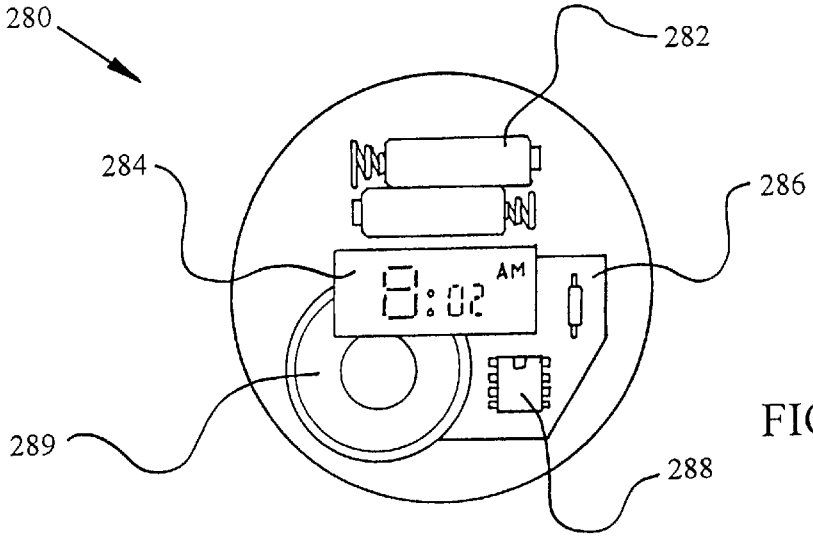
FIG. 13 is a sectional view, partially broken away, showing an electronic module mounted within the mounting device of FIG. 9.

Attention is now directed to FIG. 13 which illustrates the sectional view broken away showing the electronic components mounted inside the housing 265. The circuit board 286 carries the integrated circuit 288 which contains the control circuitry as well as the memory if provided. The miniature speaker 289 represents the sound transducer which converts the electrical signal generated by the electrical circuitry into audio sound. The display region 284 is represent by a LCD panel which shows time or other useful visual messages.

Figure 14:
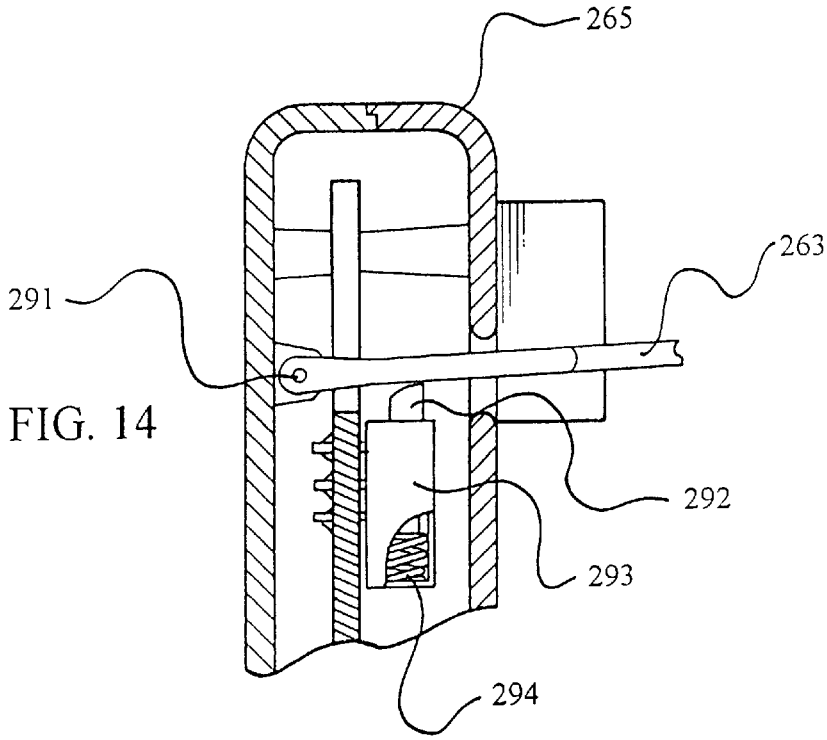
FIG. 14 is a sectional view, partially broken away, showing an embodiment of the actuator mechanism mounted within the mounting device of FIG. 9.

With continuing reference to FIG. 14 which illustrates how the lever 263 of FIGS. 9, 11 and 12 actuates a two pole two throw switch 293. The actuator lever 263, pivoted at 291, rests upon the switch pole 292 which is pre-loaded by the compression spring 294 locates inside the switch 293. When the hook of a garment hanger rests upon the actuator lever 263, the switch pole 292 is pushed downward and cause the switch 293 to change state. When the garment hanger is removed from the actuator 293, the pre-loaded spring 294 moves the pivoted lever 263 upward into the default unactuated position.

Figure 15:
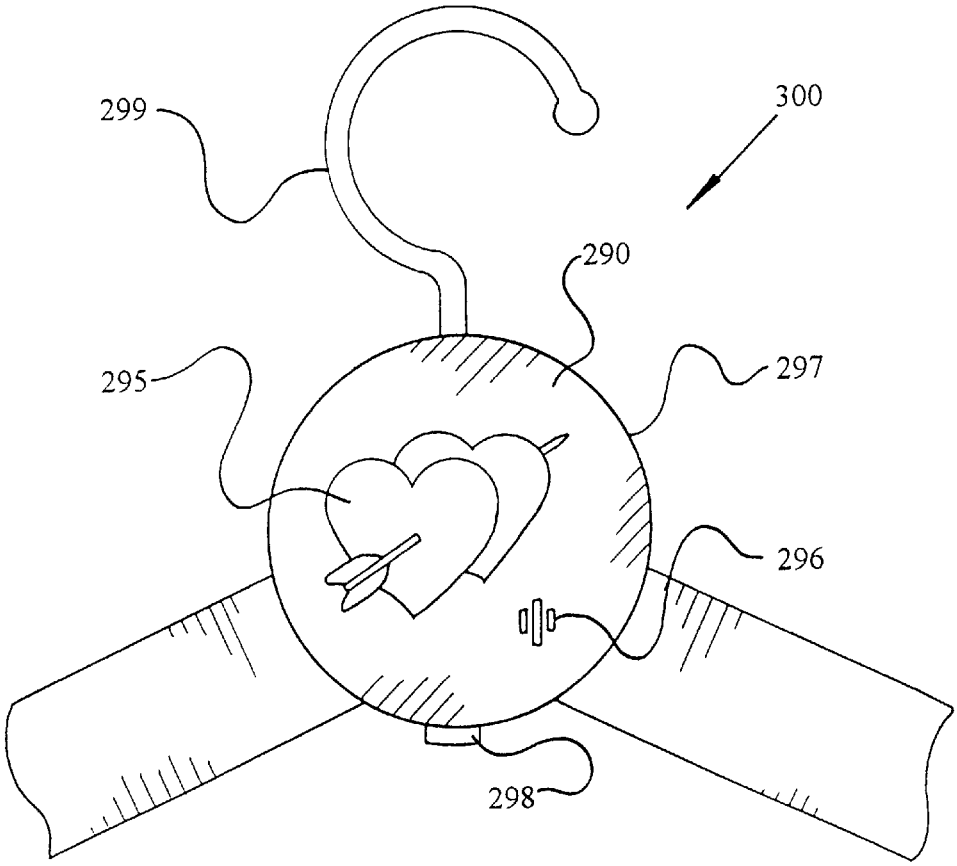
FIG. 15 is a front elevation view of an alternate embodiment of the garment hanger equipped with a recording/playback circuitry.

Attention is now directed to FIG. 15 which illustrates the application of the record/playback circuitry represented by FIG. 7 into the actuator embodiment of FIG. 5. The medial housing 290 is decorated by graphic illustration 295. Behind the opening 296 locates a sound to electricity transducer represented by a moving coil speaker or a condenser microphone. In FIG. 7, this microphone is designated by sound pick up device 212 and is connected to the power source 211 through the recording switch 215 when it is closed. The playback button 214 of FIG. 7 is represented by the push button switch 298 locates beneath the medial housing 290.

From the foregoing it should now be appreciated that several embodiments of the apparatus have been disclosed herein particularly suited for use to produce audio/visual effects. They may be use to provide useful information or courtesy greetings to customers. They may also be configured to be used by children to encourage good garment care habits and convey meaningful simple information. Various features have been disclosed in the several embodiments described herein and it should be understood that these various features can be interchanged and used with several different ones of the embodiments. For example, the mounting hook disclosed in FIG. 8 can be modified to compose a second hook on the top end so as for mounting on top of office partitions or doors without mounting screws. The garment hanger mounting means 265 which contains the electrical circuitry and the actuator can be integrally configured with the panel mounting device 240. Similarly, the switches depicted in FIGS. 2 and 5 can be integrated into the various embodiments. Similarly, various structural characteristics of the several embodiments described can be advantageously employed in various other embodiments. Accordingly, it should be understood that the embodiments described herein are exemplary and that numerous modifications, dimensional variations, and rearrangements will occur to those skilled in the art to achieve equivalent results, all of which are intended to be embraced within the scope of the appended claims.

What is claimed is:

1. An apparatus configured to support an external suspension device and to provide electrically controlled responses comprising:

first mounting means to mount said apparatus onto an external supporting object;

second mounting means to receive said external suspension device;

memory means to store electrical data;

at least one electrically energizable output device responsive to said external suspension device being placed on or removed from the second mounting means;

semiconductor circuit means to drive said electrically energizable output device according to the electrical data stored in said memory means.

2. The apparatus of claim 1 further comprises:

sound sensing means;

converting circuit means to convert the sound signal received by said sound sensing means into electrical data to be stored in said memory means.

3. The apparatus of claim 1 further comprising a switch actuator coupled to at least one of said mounting means for sensing when a load is applied to said mounting means.

4. The apparatus of claim 1 wherein said external supporting object is a panel.

5. The apparatus of claim 1 further comprising power supply means to power said apparatus.

6. The apparatus of claim 1 wherein said electrically energizable output device is a visual display.

7. The apparatus of claim 6 wherein said visual display displaying data according to said memory means.

8. The apparatus of claim 6 wherein said visual display displaying timing information.

9. The apparatus of claim 1 further comprising control switch to trigger said circuit means.

10. The apparatus of claim 1 wherein said electrically energizable output device produces audio signal.

11. The apparatus of claim 1 wherein said electrically energizable output device comprises a motor.

12. The apparatus of claim 1 wherein said memory means and circuit means are part of an integrated circuit.

13. The apparatus of claim 1 further comprising interface means to downloaded data from an external resource into said memory means.

14. An apparatus configured to support an external suspension device and to provide electrically controlled responses comprising:

first mounting means to mount said apparatus onto an external supporting object;

second mounting means to receive said external suspension device;

sound sensing means;

memory means to store electrical data representing an audio signal received by said sound sensing means in response to said external suspension device being placed on or removed from the second mounting means;

and a sound transducer to playback said audio signal.

15. The apparatus of claim 14 further comprising a switch actuator coupled to at least one of said mounting means for detecting when a load is applied or removed from said mounting means.

16. The apparatus of claim 15 wherein said switch actuator triggers playback of said audio signal.

17. The apparatus of claim 14 further comprising interface means to downloaded data from an external data source into said memory means.

18. An apparatus configured to support an external suspension device and to provide electrically controlled responses comprising:

first mounting means to mount said apparatus onto an external supporting object;

second mounting means to receive said external suspension device;

visual display means responsive to said external suspension device being placed on or removed from the second mounting means and memory means to store the data to be displayed.

19. The apparatus of claim 18 further comprising interface means to downloaded data from an external data source into said memory means.

20. The apparatus of claim 18 wherein the data stored in said memory means includes data representing alpha numerical information.

* * * * *